United States Patent [19]

Boswell

[11] 3,945,323

[45] Mar. 23, 1976

[54] IMPACT AND SELF-DESTRUCT FUZE

[75] Inventor: George T. Boswell, Springfield, Va.

[73] Assignee: The United States of America as represented by the Secretary of the Army, Washington, D.C.

[22] Filed: June 14, 1974

[21] Appl. No.: 479,404

[52] U.S. Cl. ..... 102/71; 102/72; 102/73 A

[51] Int. Cl.[2] ..... F42C 9/10

[58] Field of Search ..... 102/65.2, 65.4, 71, 72, 102/73 R, 73 A, 49.4, 49.5

[56] References Cited

UNITED STATES PATENTS

| | | | |
|---|---|---|---|
| 2,714,353 | 8/1955 | Greer | 102/72 |
| 2,763,212 | 9/1956 | McCaslin | 102/72 |
| 2,857,847 | 10/1958 | Seavey | 102/71 X |
| 2,872,868 | 2/1959 | Donahue, Jr. et al. | 102/78 |
| 2,938,463 | 5/1960 | Jasse | 102/71 |
| 3,007,412 | 11/1961 | Kepfer | 102/72 |
| 3,106,162 | 10/1963 | Hagerty | 102/49.4 |
| 3,371,608 | 5/1968 | Webb | 102/72 |
| 3,457,382 | 7/1969 | Boswell | 102/71 X |
| 3,660,794 | 5/1972 | Brizzolara | 337/401 |
| 3,855,932 | 12/1974 | Parker et al. | 102/49.5 |

*Primary Examiner*—Samuel W. Engle
*Assistant Examiner*—Harold Tudor
*Attorney, Agent, or Firm*—Nathan Edelberg; Robert P. Gibson; Max Yarmovsky

[57] ABSTRACT

An omnidirectional impact and self-destruct fuze for initiation of a grenade has a primer which after being initiated ignites a delay column. The delay column melts an eutectic metal arming plug which unlocks a ball detent to permit a striker assembly to be responsive to an impact sensor. If upon impact the inertial force of an impact weight fails to displace an impact spring so that it will release the spring biased striker against a detonator, the burning delay column will subsequently ignite a flash mix and melt a self-destruct nut, thereby releasing a retainer screw and the striker assembly therefrom so that the latter will forcibly hit the detonator causing the grenade to self-destruct.

4 Claims, 6 Drawing Figures

IMPACT AND SELF-DESTRUCT FUZE

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to insure the initiation of a grenade upon impact and its self-destruction after a period of time after impact to prevent the grenade from being picked up by unfriendly troops and thrown back. One of the problems with prior art devices has been that in order to accomplish these two functions in their proper sequence required the use of mechanisms which had many complicated parts. Such prior art devices because of their numerous parts and complexity are costly to make and are particularly unsuitable for use in low cost reusable practice grenades. Another problem with prior art fuzes utilizing delay columns has been the premature detonation of the device because of malassembly, missing parts, or abuse. The present invention overcomes these aforementioned problems by its unique design.

SUMMARY OF THE INVENTION

The present invention relates to a low cost multi-directional impact self-destruct fuze suitable for use in reusable practice grenades. The fuze has a tubular case which holds a primer assembly in a first end and a detonator assembly in its other end. An arming-firing assembly, containing a pyrotechnic delay column and arming plug and ball, is operatively positioned against the primer assembly. An impact sensor assembly is attached to the arming-firing assembly by means of a screw threadedly attached to a self-destruct nut. A striker assembly is biasedly held by the arming-firing assembly by means of a screw threadedly attached to a self-destruct nut. A striker assembly is biasedly held by the arming-firing assembly when the device is in a "safe" condition. When the fuze is placed in an "armed" condition the striker assembly can be actuated either by an inertial force acting on the impact sensor assembly or as the result of the pyrotechnic delay column initiating the self-destruct nut so that the nut releases the biased striker assembly to forcibly impact against a detonator.

An object of the present invention is to provide a multi-directional impact and self-destruct fuze.

Another object of the present invention is to provide a multi-directional impact and self-destruct fuze which insures against premature detonation.

Another object of the present invention is to provide a multi-directional impact and self-destruct fuze which is low in cost.

Another object of the present invention is to provide a fuze which will function during a first interval of time by impact and in the event of failure to function as a result of impact to function after a second interval of time.

Another object of the present invention is to provide a multi-directional impact and self-destruct fuze which is completely safe while in storage.

Another object of the present invention is to provide a multi-directional impact and self-destruct fuze capable of operating after a prolonged period of storage.

A further object of the present invention is to provide a multi-directional impact and self-destruct fuze which insures arming of the fuze by the melting of an eutectic metal arming plug.

For a better understanding of the present invention, together with other and further objects thereof, reference is made to the following description taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
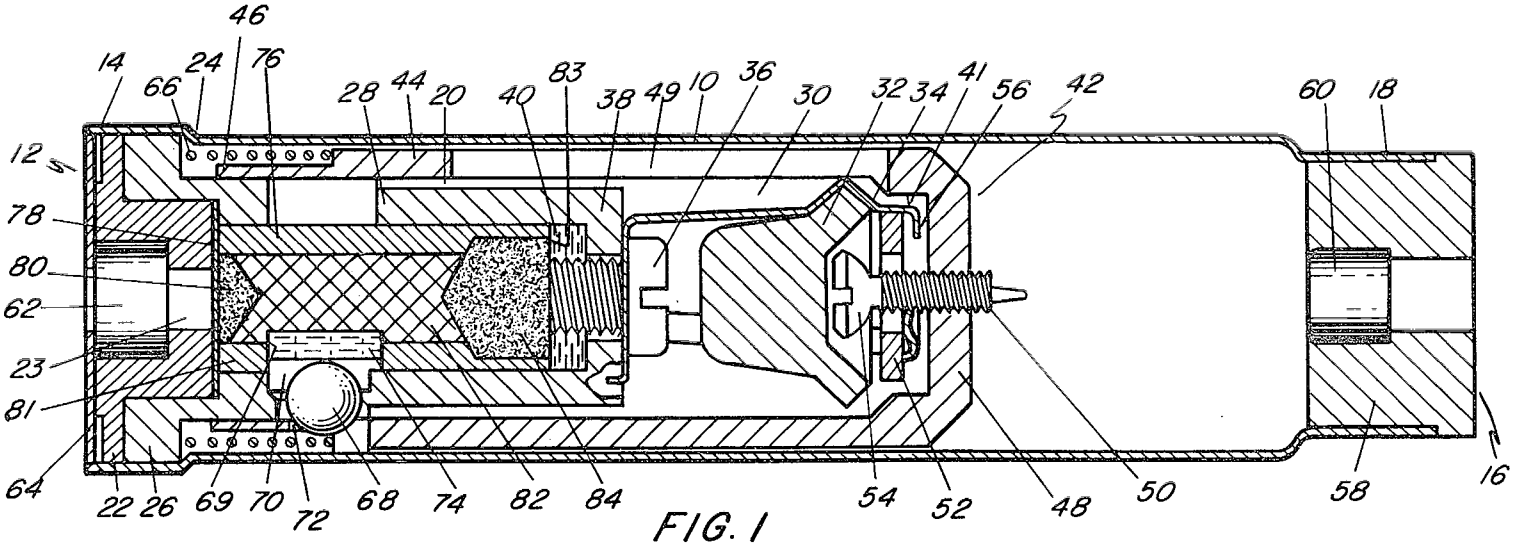
FIG. 1 is a longitudinal cross-sectional view of the fuze in a safe position.

Referring now to FIG. 1 a tubular housing 10 has five subassemblies contained therein. A primer assembly 12 is held in housing first end 14 and a detonator assembly 16 is positioned in the housing's second end 18. An arming-firing assembly 20 is axially aligned in the housing 10 and fixedly held against the primer housing 22 by housing shoulder 24 pressing against delay housing shoulder 26 of delay housing 28. An impact sensor assembly 30 comprises an impact weight 32, an impact spring 34 having cup-shaped leaves, and a screw 36, which passes through the spring 34. The screw 36 fixedly holds spring 34 to the forward end 38 of delay housing 28 by engagement with the self-destruct nut 40. Striker assembly 42 comprises a cup-shaped striker body member 44 having an open end 46, a closed end 48 and a longitudinal slot 49. Striker body 44 slidably fits within housing 10 and is slidably positioned over delay housing 28. A striker 50 is screwed into striker body closed end 48 and extends axially and longitudinally therefrom toward detonator assembly 16. A striker release washer 52 is positioned intermediate striker head 54 and impact spring L-shaped prongs 56. Detonator assembly 16 comprises a detonator holder 58 stakedly held by housing 10 in its second end 18, and a detonator 60 axially positioned within holder 58. In a similar manner a primer 62 is axially positioned in primer housing 22, and retained therein by a primer retainer disc 64. Primer 62 communicates with flash disc 78 through axial flash hole 23. The arming-firing assembly 20 utilizes a biased firing spring 66 to urge the striker body 44 toward the detonator assembly 16. In the safe position, as shown by FIG. 1, a ball 68 is positioned in a delay column transverse bore 69, a delay housing transverse bore 70 and in a transverse body bore 72. The ball 68 is held in this safe position by a eutectic metal arming plug 74. A hollow delay column member 76 is held intermediate flash disc 78 and self-destruct nut 40. An initiator charge 80 is located in delay column rear end 81, and a delay charge 82, which is intermediate initiator charge 80 and flash charge 84; the latter is located in delay column forward end 83.

Figure 2:
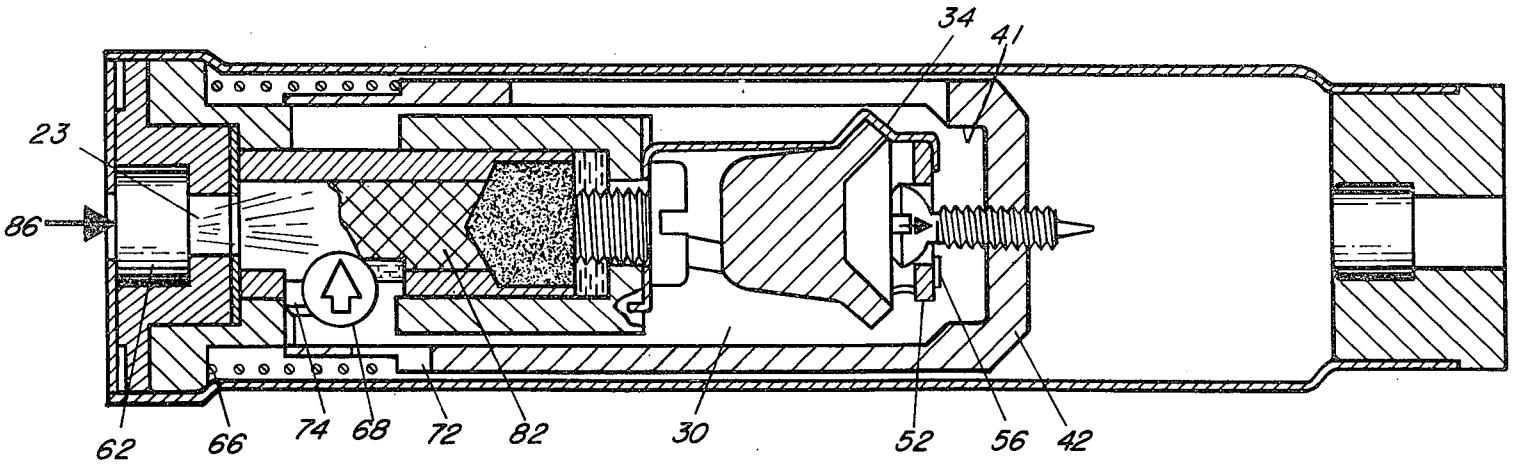
FIG. 2 is a longitudinal cross-sectional view of the fuze in an armed position.

Referring now to FIG. 2 the fuze primer 62 is initiated by a buchon striker 86 of a grenade (not shown). The primer 62 fires through flash hole 23, ruptures flash disc 78 and ignites initiator charge 80 which in turn ignites the delay charge 82. The delay charge 82 melts eutectic metal arming plug 74 thereby allowing the firing spring 66 to force the arming ball 68 out of striker assembly body bore 72. The movement of the striker assembly 42 away from the impact sensor assembly 30 activates the impact sensor assembly 30 by withdrawing impact cup-shaped spring leaves 34 from counterbore 41. This separation between striker assembly 42 and impact sensor assembly 30 permits the release washer 52 and the striker assembly 42 to be restrained only by the L-shaped spring prongs 56.

Figure 3:
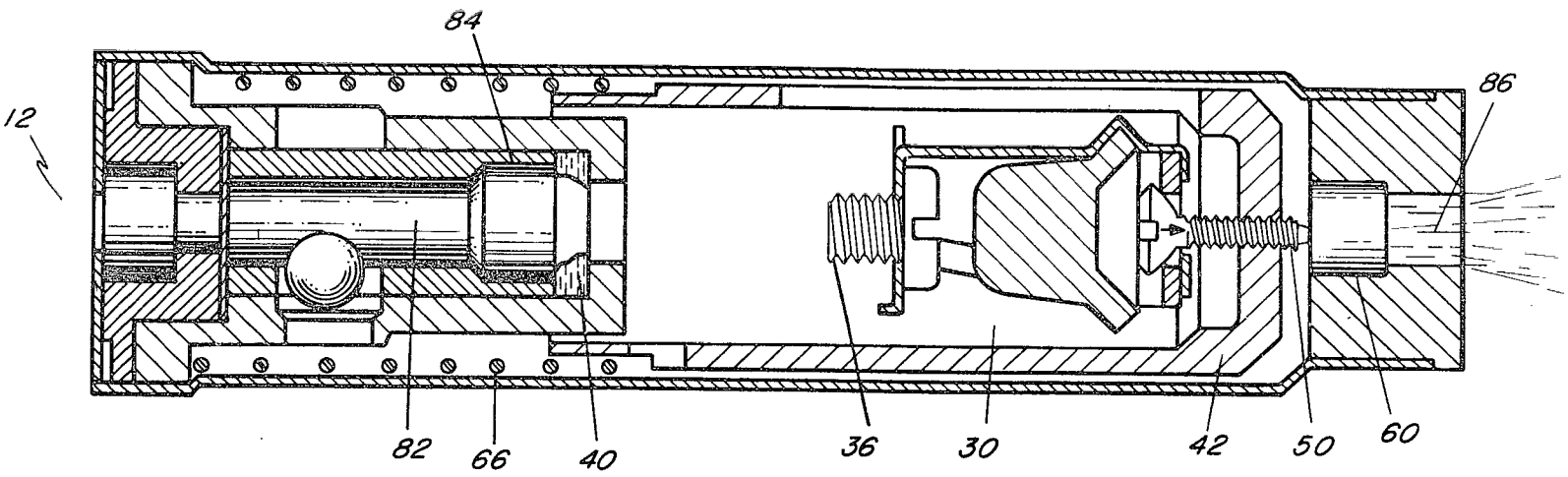
FIG. 3 is a longitudinal cross-sectional view of the fuze in its self-destruct functioning position.

FIG. 3 shows the fuze in its self-destruct functioning position. In the event that impact functioning does not occur within a first interval of time the delay column 82 continues to burn. The first interval of time aforementioned constitutes the time it takes for delay column 82 to ignite flash charge 84 after delay column 82 has melted eutectic metal arming plug 74 and placed the fuze in an armed position by actuating impact sensor assembly 30 as aforedescribed. At the end of this first interval of time the delay column 82 ignites the flash or heat producing charge 84 which in turn melts the eutectic metal self-destruct nut 40 thereby freeing screw 36. The length of time it takes flash charge 84, after initiation by delay column 82, to melt the eutectic metal self-destruct nut 40 constitutes a second interval of time. Once the screw 36 is released firing spring 66 forces the striker assembly 42 with the impact sensor assembly 30 to impact detonator 60. Detonator 60 fires through flash hole 86 initiating the booster or main grenade charge (not shown).

Figure 4:
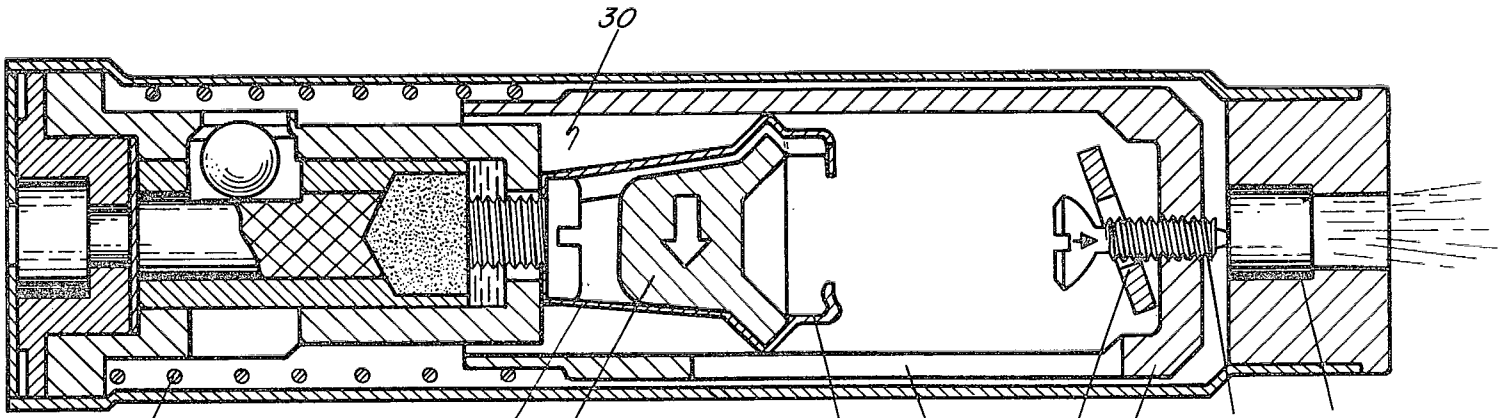
FIG. 4 is a longitudinal cross-sectional view of the fuze in its omnidirectional impact functioning position after it has experienced a side impact.
Figure 6:
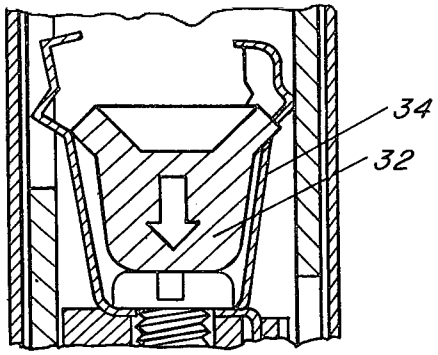
FIG. 6 is a partial longitudinal cross-sectional view of the fuze it its multi-directional impact functioning position after it has experienced a primer end impact.
Figure 5:
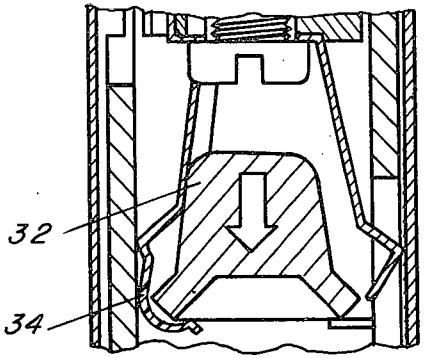
FIG. 5 is a partial longitudinal cross-sectional view of the fuze in its omnidirectional impact functioning position after it has experienced a detonator end impact.

Referring now to FIGS. 4, 5 and 6 the fuze after being armed, as shown by FIG. 2, is capable of multi-directional impact functioning. FIG. 4 shows the operation of the impact sensor assembly 30 in the event that the fuze is subject to side impact during the first interval of time and before the end of the second interval of time. A side impact causes the impact weight 32 to exert an inertial force against the leaves 34, which pushes at least one of the leaves 34 into slot 49. The spreading apart of a prong or prongs 56 permits release washer 52 to swivel sufficiently free of the other prongs 56. The unrestrained washer 52 releases the striker assembly 42 so that firing spring 66 drives it toward detonator 60 and causes striker 50 to impact therewith. In FIG. 5 the impact weight 32 is shown in its forward position spreading apart leaves 34 as a result of the inertial forces caused by a detonator end impact. FIG. 6 shows the weight 32 moving the leaves 34 apart as a result of inertial forces caused by a primer end impact. In both of the last two aforementioned modes of impact the effect on release of washer 52 and movement of the striker assembly 42 are the same as aforedescribed for the side impact condition.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described this invention, what is claimed as new and desired to be secured by Letters Patent of the United States is:

1. An impact and self-destruct fuze for initiating a grenade which comprises:

a tubular housing having a first end and a second end;

primer means fixedly positioned in said first end for initiating said fuze;

arming-firing means axially and fixedly positioned against said primer means and responsive thereto for placing said fuze in an armed condition during a first interval of time and for firing said fuze after a second interval of time which includes;

a delay housing axially aligned and positioned against said primer means, said delay housing having a transverse delay housing bore therein, a rear end and a forward end;

a flash disc positioned intermediate said primer means and said delay housing;

a hollow delay column member axially positioned in said delay housing, said column having a transverse delay column bore therein communicating with said transverse delay housing bore;

an initiator charge axially positioned adjacent said flash disc in the rear end of said column member;

a flash charge axially positioned in said forward end of said delay column member;

a delay charge positioned in said column member intermediate said initiator charge and said flash charge;

a eutectic metal arming plug positioned in said delay column transverse bore in juxtaposition to said delay charge;

an arming ball operatively positioned in the transverse bores of said delay housing and said delay column;

a self-destruct nut positioned within said forward end and adjacent said flash charge said nut being intermediate said delay column and said delay housing;

impact sensor means releasably connected to said arming-firing means for actuating said fuze in the event of an impact during said first interval of time; and before the end of said second interval of time a screw threadedly connected to said self-destruct nut for releasably connecting said delay housing to said impact sensor means;

detonator means axially fixedly positioned in the second end of said tubular housing for exploding said grenade; and biased striker means, mechanically restrained by said arming-firing means when said fuze is in a safe condition, said striker means being releasably held by said impact sensor means during said first interval of time and before the end of said second interval of time for initiating said detonator means upon impact of said fuze and after passage of said second interval of time;

wherein said plug melts when heated by said delay charge releasing said arming ball so that it is not in interference with said striker means and places said fuze in said armed condition, and said self-destruct nut melts during said second interval of time releasing said striker means to impact said detonator means, thereby causing said fuze to self-destruct.

2. A fuze as recited in claim 1 wherein said primer means comprises:

a primer housing;

a primer axially positioned in said primer housing; and a primer retainer disc positioned against said primer and primer housing for holding said primer and primer housing in said tubular housing.

3. A fuze as recited in claim 1 wherein said impact sensor means comprises:

a spring having a plurality of cup-shaped leaves, with L-shaped prongs thereon for preventing release of said striker means when said fuze is in said safe condition, said screw holding said spring fixedly attached to said arming-firing means when said fuze in in said safe and armed condition; and an impact weight slidably held within said cup-shaped leaves, which spreads said leaves apart and releases said striker means from said sensor means during said first time interval upon receipt of a substantial impact to said fuze.

4. A fuze as recited in claim 3 wherein said striker means comprises:

a cup-shaped body member slidably positioned in said tubular housing having a first open end, a second end, a longitudinal slot and a transverse body bore through the side wall of said member;

a spring biasedly positioned intermediate the open end of said body member and said delay housing for urging said striker means towards said detonator means;

a striker positioned in said second end of said body member and partially protruding therethrough, said striker being axially aligned with said detonator means; and a washer member positioned intermediate said prongs and said striker for restraining said striker assembly from moving toward said detonator assembly when said fuze is in said safe condition and releasing said striker assembly to impact said detonator assembly when an impact of substantial force is given to said fuze when said fuze is in said armed condition.

* * * * *